US008807192B2

(12) United States Patent
Marocco

(10) Patent No.: US 8,807,192 B2
(45) Date of Patent: Aug. 19, 2014

(54) BLIND WITH MULTIPLE PANELS AND CONTROLS

(75) Inventor: Mario M. Marocco, Toronto (CA)

(73) Assignee: Maxxmar Inc., Toronto, Ontario (CA)

( * ) Notice: Subject to any disclaimer, the term of this patent is extended or adjusted under 35 U.S.C. 154(b) by 427 days.

(21) Appl. No.: 13/067,189

(22) Filed: May 16, 2011

(65) Prior Publication Data

US 2012/0291962 A1 Nov. 22, 2012

(51) Int. Cl.
*E06B 9/42* (2006.01)

(52) U.S. Cl.
USPC ..... 160/120; 160/321

(58) Field of Classification Search
USPC ..... 160/120, 85, 86, 321, 323.1, 121.1
See application file for complete search history.

(56) References Cited

U.S. PATENT DOCUMENTS

| | | | | | |
|---|---|---|---|---|---|
| 1,108,681 | A | * | 8/1914 | Berchtold | 160/99 |
| 2,280,358 | A | * | 4/1942 | Tietig | 160/120 |
| 2,581,433 | A | * | 1/1952 | North et al. | 160/120 |
| 3,308,872 | A | * | 3/1967 | Smith | 160/120 |
| 4,250,597 | A | | 2/1981 | Ford et al. | |
| 4,369,829 | A | * | 1/1983 | Casiday | 160/120 |
| 4,418,739 | A | * | 12/1983 | Woolnough et al. | 160/120 |
| 4,453,584 | A | * | 6/1984 | Steele | 160/121.1 |
| 4,516,618 | A | * | 5/1985 | Gardner et al. | 160/120 |
| 4,679,406 | A | * | 7/1987 | Weiblen | 62/262 |
| 4,813,468 | A | | 3/1989 | Fraser | |
| 4,955,421 | A | | 9/1990 | Torti | |
| 5,054,534 | A | | 10/1991 | Hong | |
| 5,092,389 | A | * | 3/1992 | Tedeschi | 160/321 |
| 5,137,073 | A | * | 8/1992 | Huang | 160/321 |
| 6,666,251 | B2 | * | 12/2003 | Ikle | 160/120 |
| 6,971,435 | B2 | | 12/2005 | Rasmussen | |
| 7,059,377 | B2 | | 6/2006 | Nien et al. | |
| 7,174,940 | B2 | * | 2/2007 | Nien | 160/120 |
| 7,195,052 | B2 | | 3/2007 | Nien et al. | |
| 7,207,371 | B2 | * | 4/2007 | Hsu | 160/85 |
| 7,267,156 | B2 | * | 9/2007 | Byeon | 160/121.1 |
| 7,740,047 | B2 | | 6/2010 | Koop et al. | |
| 7,806,160 | B2 | * | 10/2010 | Byeon | 160/85 |

* cited by examiner

*Primary Examiner* — David Purol

(57) ABSTRACT

A blind for a building opening, and having a head rail, attachable adjacent to the building opening; a first blind panel stored in the head rail, and adapted to be lowered as a loop defing two loop parts, over the building opening; a second blind panel stored in the head rail and adapted to be lowered over the building opening, and wherein the first panel is formed of light permeable material, whereby to admit at least some light into the interior of the building, and the second panel is formed of light impermeable material; transverse blind strips on the first panel, at spaced intervals there across; and, blind panel control mechanism in the head rail whereby the first blind panel loops can be adjusted so as to adjust the transverse blind strips between open and closed positions.

14 Claims, 5 Drawing Sheets

BLIND WITH MULTIPLE PANELS AND CONTROLS

FIELD OF THE INVENTION

The invention relates to blinds for windows, in which the blind consists of two panels of blind material, where a first panel and a second panel hang as separate panels, and to a blind header rail incorporating two rollers for the two panels, and in particular to such a blind where the front panel hangs in a double loop, which can be adjusted to provide varying light effects.

BACKGROUND OF THE INVENTION

In the past, conventional blinds for windows have typically been either venetian style blinds with transverse strips, or so called vertical blinds. These blinds could have a mechanism whereby the strips could be rotated between closed and open positions. However in the open position, in which light is transmitted into the room, there was also a loss of privacy. In the closed position, the light was obscured.

Other blinds are known which simply consist of a panel of thick flexible material, wound onto a roller in a headrail. The material can be pulled down for privacy, and to obscure the light, or raised, to allow passage of light, but with loss of privacy.

Recent developments in blind design have found that consumers are interested in obtaining blinds with a greater variety of light and dark effects, but which none the less provide for privacy.

In these types of blinds, two separate panels of blind material are provided, which may hang down over the window opening. A first translucent panel is stored on a first roller in the head rail. The material of this first panel is light permeable, but provides privacy. As a result, even when the first panel lowered, the room still receives some light.

A second blind panel is stored in the head rail and is formed of opaque material. When complete light exclusion is required this second panel can be lowered.

Both blind panels are stored in the same head rail, on separate rollers.

In another of these types of blinds, two separate panels of blind material are provided, which may hang down over the window opening. A first translucent panel is stored on a first roller in the head rail, and hangs down in a loop. The material of this first panel is light permeable, in some areas and less permeable or "dark" in other areas, but provides privacy. As a result, even when the first panel lowered, the room still receives exterior light. By varying the positions of the two portions of the loop of the first panel, it is possible to provide a greater or lesser degree of exclusion of light, and privacy.

In addition to the loop of the first panel of translucent material, these blinds also incorporate a second panel of thicker light impermeable material. This second panel is wound on a second roller in the head rail.

When this second panel is lowered, it provides for complete light exclusion, which may be desirable for sleeping.

The design of a blind header rail providing two rollers, for handling two such panels, and providing for relative movement between one portion of the first or looped panel and the other portion of the same panel, and also the provision of the second roller for the second panel, presents numerous problems. In the first place the head rail must be compact and aesthetically pleasing. Desirably the blind head rail shall occupy no more space, or only slightly more space at the top of the window opening than previously known blinds.

The operation of the two separate blind panels must be simple and capable of being operated by either manual controls, or in the case of more complex designs by means of power controls, and even remotely operated power controls.

The first or loop panel is usually translucent and usually has transverse opaque strips, spaced apart from one another, which can provide greater or lesser degrees of light transmission or exclusion. By the operation of the first roller one loop of the first panel can be moved relative to the other loop. This also provides for some degree of privacy. The transverse strips, in the two sides of the loop, can then be aligned, thus leaving open the translucent strips between them and thus allow light to permeate the two loops of the first blind panel. Alternatively the opaque strips of one part of the loop can be made to register with the translucent strips in the other portion of the loop so that more light is excluded.

In addition, it is also desirable to provide mechanism for the first roller and mechanism for the second roller in the blind head rail by which either or both of first and second panels can be raised up out of the window opening, so as to leave the window opening clear and free of the blind all together.

The blind controls are usually chains or cords, hanging down from the headrail, and controlling the first and second rollers.

One of the problems experienced with such cords is that some space must be allowed for the cord loops to hang beside one edge of the blind panels.

This space along one vertical edge of the blind panels, then allows some light in, and the blind fails to obscure all light.

Another problem is that when an operator manipulates the cords, the edges of the panels gradually become damaged. The appearance, and life, of the blind is therefor impaired.

It will be seen that this form of blind provides a front panel which is in effect two panels, one of which two panels is an intermediate panel located between the front panel and the rear panel, so that there are three panels of blind material hanging down from the one headrail.

BRIEF SUMMARY OF THE INVENTION

With a view to achieving the foregoing desirable features, the invention provides a blind for a building opening, and having a head rail, attachable above the building opening, a first blind panel stored in the head rail, and adapted to be lowered over the building opening, a second blind panel stored in the head rail and adapted to be lowered over the building opening, the first blind panel being formed of light permeable material, whereby to admit at least some light into the interior of the building, and the second panel being formed of light impermeable material, and control cord mechanism in the head rail with cord guides in the head rail to lead the control cords forwardly in front of the blind panels, so that the control cords hang forwardly of the edges of the first and second blind panels, to avoid damaging the edges of the blind panels, and permitting the blind panels to fit the building opening to maximize privacy and light exclusion.

Preferably the invention provides such a blind in which the first blind panel hangs in a loop forming two sheets or parts of the first panel. Transverse blind strips, alternating between light permeable or translucent, and less permeable or dark, are formed in the first panel, at spaced intervals there across. Blind panel control mechanism in the head rail enables the first blind panel to be adjusted so that one part of the loop moves relative to the other. In this way the alternating the blind strips between open and closed positions.

Preferably the blind will further include a bottom rail attached to the loop of the first blind panel for holding, providing a mass weight to hold the loop of the first blind panel in position.

Preferably the blind will incorporate blind panel control mechanisms and control cords for each of said first and second blind panels whereby the same can be controlled and adjusted and raised upwardly and stored in the head rail.

In particular, the head rail will incorporate a first blind roller mechanism, and first blind panel cord guide channels surrounding said first blind roller, and further including second blind roller mechanism and second blind panel cord guide channels, surrounding said second guide roller mechanism.

Preferably the first blind panel cord guide channels will terminate adjacent a lower edge of the blind head rail, and the second blind panel cord guide channels will terminate at a region intermediate the lower edge and upper edge of the head rail, and the second cord guide channel being displaced so as to lie alongside portions of the first cord guide channel.

Preferably there is a blind anchor in the head rail for anchoring the end of the first panel so that it may hang in a loop.

Preferably there is a guide wall in the head rail for guiding the second blind panel, and separating it from the first panel.

Preferably the head rail is formed of an elongated channel with a front wall, a top wall, and a back wall, and end cap members attached at each end of said channel, and blind roller supports incorporated in said end caps.

The invention thus provides a blind and head rail in which a front panel is a loop of material which is in effect two panels, one of which two panels is an intermediate panel located between the front panel and the rear panel, so that there are three panels of blind material hanging down from the one head rail, and control cords are lead forwardly of the edges of the panels, so as to permit the panels to fill the space of the opening.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
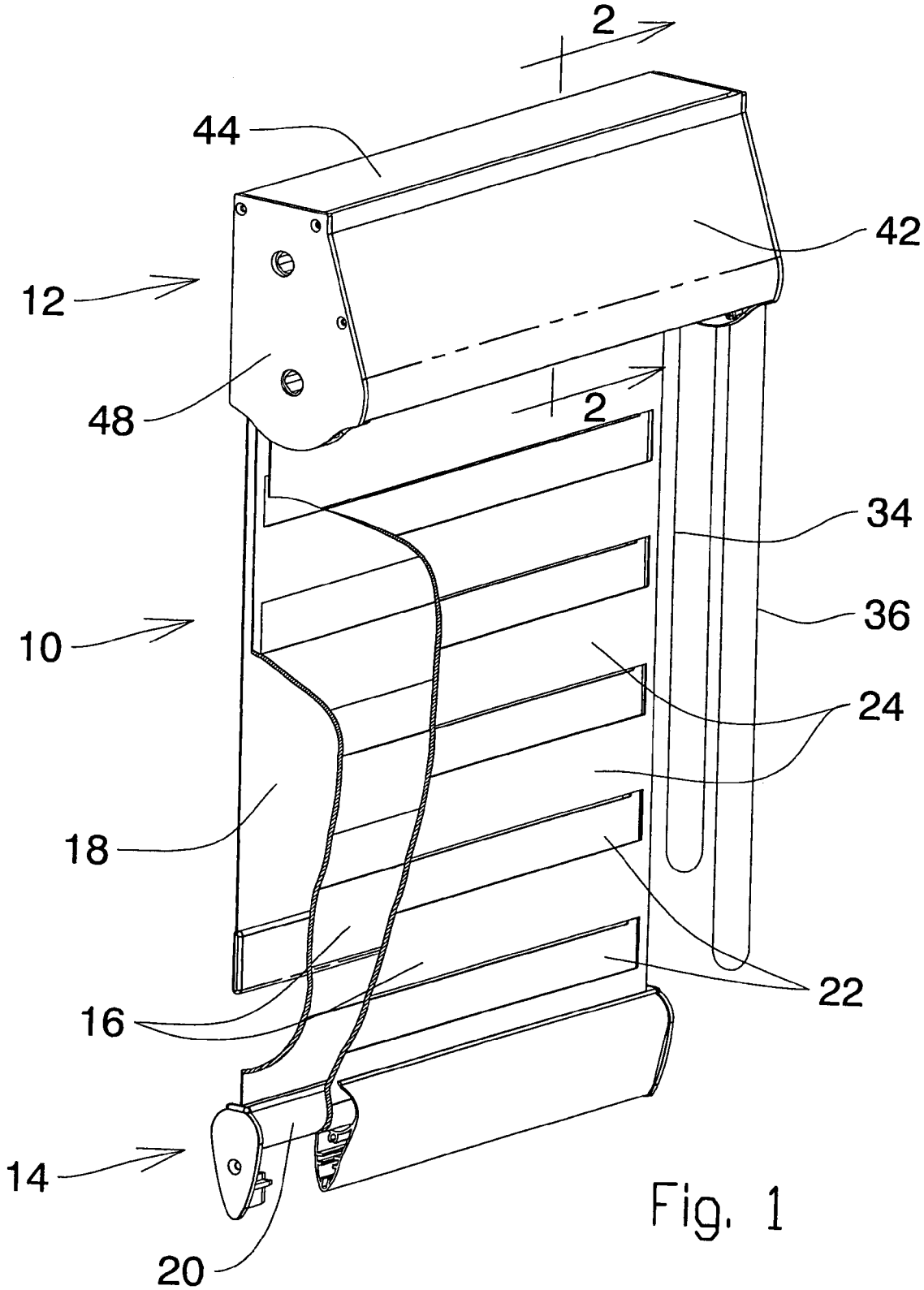
FIG. 1 is a general perspective of a typical blind illustrating the invention and showing a first looped blind panel, with alternating light and dark transverse blind strips, and a second opaque blind panel, and a head rail.

It will be seen that the blind illustrated generally as (10), comprises a head rail (12) and a bottom rail (14). The blind is typically located over a building opening such as a window.

The blind, in this first embodiment, provides a first looped translucent blind panel (16) and a second opaque blind panel (18). It will be seen that the first and second blind panels are supported so as to hang vertically. The second panel (18) has the usual bottom rail, of a type well known in the art.

First panel (16) passes around a bottom rail roller (20) in the bottom rail (14), so as to hold the looped panel in position.

As shown the front panel is a loop, so that its two portions form in effect two panels hanging down, one panel being spaced from the other.

The two panels can be considered as a front panel and an intermediate panel.

The second panel, which is the rear panel, hangs behind the front and intermediate panel.

The first and second blind panels are spaced apart from one another.

The first blind panel is formed of light permeable material, which is at least partly translucent, so that light can pass through and permit at least some light to pass into the interior of the building, even when the first panel is lowered.

In order to provide for a greater or lesser exclusion of light, first blind panel (16) is provided with transverse darker blind strips (22). Strips (22) are formed of thicker material such that it is at least less light permeable, than the fabric of the blind panel. The strips (22) are located at spaced intervals. Between the strips (22), spaces (24) of the fabric of the first panel (16) are more light permeable., thus providing alternating light and dark strips.

As shown, the first panel hangs down in a loop. By adjusting the loop it is possible to either align the dark strips (22) in the two parts of the loop with each other, and thus align the light strips (24) with each other. This will provide passage of light through the lighter strips. By adjusting the loop slightly, the dark strips (22) in one part of the loop can be made to align or register with the light strips (24) in the other part of the loop, providing more privacy and less light.

By suitable mechanism (described below) the first and second blind panels can be adjusted, and raised or lowered, and can be retracted back up into the head rail (12) in order to provide a completely open area in the building opening or window.

In order to provide for these functions the head rail (12) carries an upper second panel roller (30), and a lower first panel roller (32), located below the roller (30).

The two rollers are operable, in this embodiment by respective first and second control cords (34) and (36).

Head rail (12) comprises an elongated transverse channel, preferably of extruded metal, and having screw receiving mouldings (40) formed therein.

Head rail (12) defines a front cover wall (42), a top wall (44) and a back wall (46). Suitable mounting devices (not shown), for securing the blind to a building, can be secured to the back wall or top wall, depending on the fabric of the building to which it is be attached.

At each end of head rail (12) there is an end cap (48), preferably formed of thermoplastic.

The end cap (48) comprises a main body (50) having a flat planar exterior. Holes (52) in body (50) allow screws to be passed through and secured in screw mouldings (40) in head rail (12).

Main body (50) is formed with integral upper and lower hub bearings (54) and (56). An upper stub sleeve (58) is rotatably mounted in upper hub bearing (54) A lower stub sleeve (60) is rotatably mounted in lower hub bearing (56).

An upper drive gear (62), mounted on hub (54) is connected to the upper stub sleeve (58), A lower drive gear (64) mounted on hub (56) is connected to the lower stub sleeve (60).

Cover plate (66) has openings which fit over the sleeves (58) and (60) and is secured to main body (50).

The drive gears receive respective upper and lower control cords (34) and (36). Such cords, as is well known, hang down in endless loops, and one or other of the loop portions can be grasped and drawn down, to operate the respective stub shafts.

The cords, in this case, are the typical metal chain cord, having metal spheres connected together by wire links, such as are well known in the art. The spheres are also commonly made of thermoplastic, in a variety of colours.

Cords of other designs are known and could be used.

All such cords, whether chains, or cords of any other type are referred to herein as control cords, or as cords, wherever these words are used, and are deemed to include all such chains, cords, and the like of whatever type.

The main body (50) of the end cap (48) is formed with upper cord guide ribs (70) and an intermediate ribs (72), and lower ribs (74).

The ribs (70) and (72) and (74) define between them cord paths or channels for the upper cord. The ribs thus guide the upper cord loop downwardly and extend in an arc around and forward of the lower sleeve (60), and gear (64).

In this way the cord loop for the upper hub shaft will hang well forward of the edges of the first and second blind panels (16) and (18).

The lower cord loop extends around lower drive gear (64) and is enclosed by ribs (74) and (76) forming a cord guide path or channel, for the lower cords.

Lower rib (76) is hollow and rounded and extends at (78) forward to, or beyond, the axis of lower hub (56). Lower rib (78) thus guides the lower cord loop so that it too hangs forward of the edges of the first and second blind panels.

While the guide ribs are formed integrally with the main body, in this example, they could be formed separately, and attached, or held in position, in various ways.

Upper blind roller (32) makes a friction fit on sleeves (58), at each end.

Lower blind roller (30) makes a friction fit on sleeves (60) at each end.

Each blind roller has a groove (80) in which edges of the respective blind panels are secured.

An intermediate loop fastening wall (82) which in this case is formed of extruded metal, for example, but could be formed in other ways, is secured in a groove (84) inside the front wall (42) of the head rail (12).

The wall (82) is, in this case, removable, by sliding out of the groove. However, the wall could be permanently fastened to the head rail, or could be formed integrally with the head rail.

The fastening wall (82) extends between the upper and lower rollers (30) and (32), and terminates adjacent to but spaced from the back wall (46). A first blind panel loop fastening groove (86) is formed along the free edge of wall (82), and the free end of front looped blind panel (16) is secured in groove (86).

Second blind panel (18) passes between separator wall (88) and back wall (46). In operation the first or front panel (16) can be lowered, while the second panel (18) remains retracted.

As front panel (16) is lowered it will run around roller (20) in the bottom rail (14). If light is required then the front panel can be adjusted so the dark strip (22) align with each other. This will allow passage of light through the intervening light strips. (24) If less light is required, or for greater privacy, the front panel can be adjusted so that the dark strips line up with the lighter intervening strips.

It will be seen that the front panel forms in effect two panel portions, namely a front portion and an intermediate portion, spaced from one another. Adjustment of the front and intermediate portions relative to one another, changes the lighting effect inside the building space.

For complete light exclusion the second blind panel (18) is lowered.

However the first panel may be allowed to remain hanging down and provides a pleasing aesthetic decorative effect.

The operation of the blind panels by the cords and the manipulation of the cords, can be managed forwardly of the two blind panels, and without contact their edges.

In addition by guiding the cord loops to hang forwardly, the blind panels can fill the full width of the building opening or window, and thus provide maximum privacy, and exclusion of light.

Figure 5:
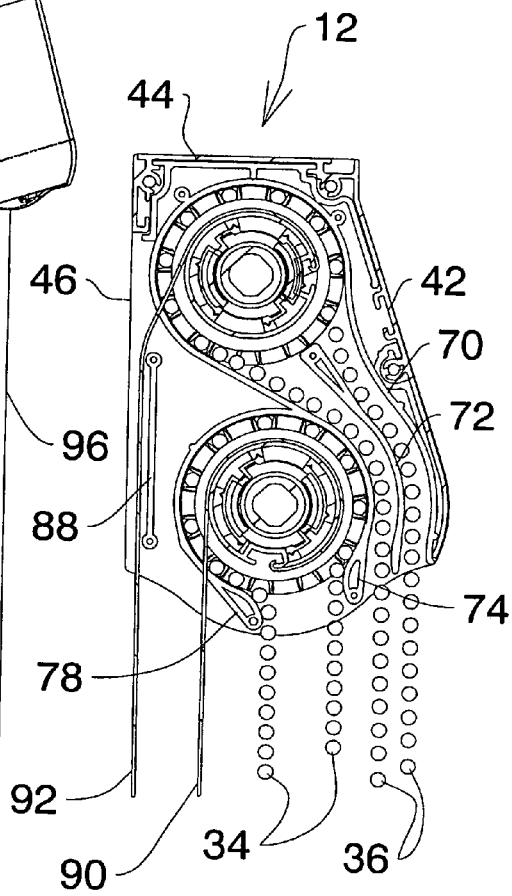
FIG. 5 is a section corresponding to FIG. 2 showing another embodiment.

A somewhat simplified embodiment is shown in FIG. 5.

In this case the front blind panel (90) is a single sheet. There is no loop.

The lower end is attached to a bottom rail (92).

Figure 2:
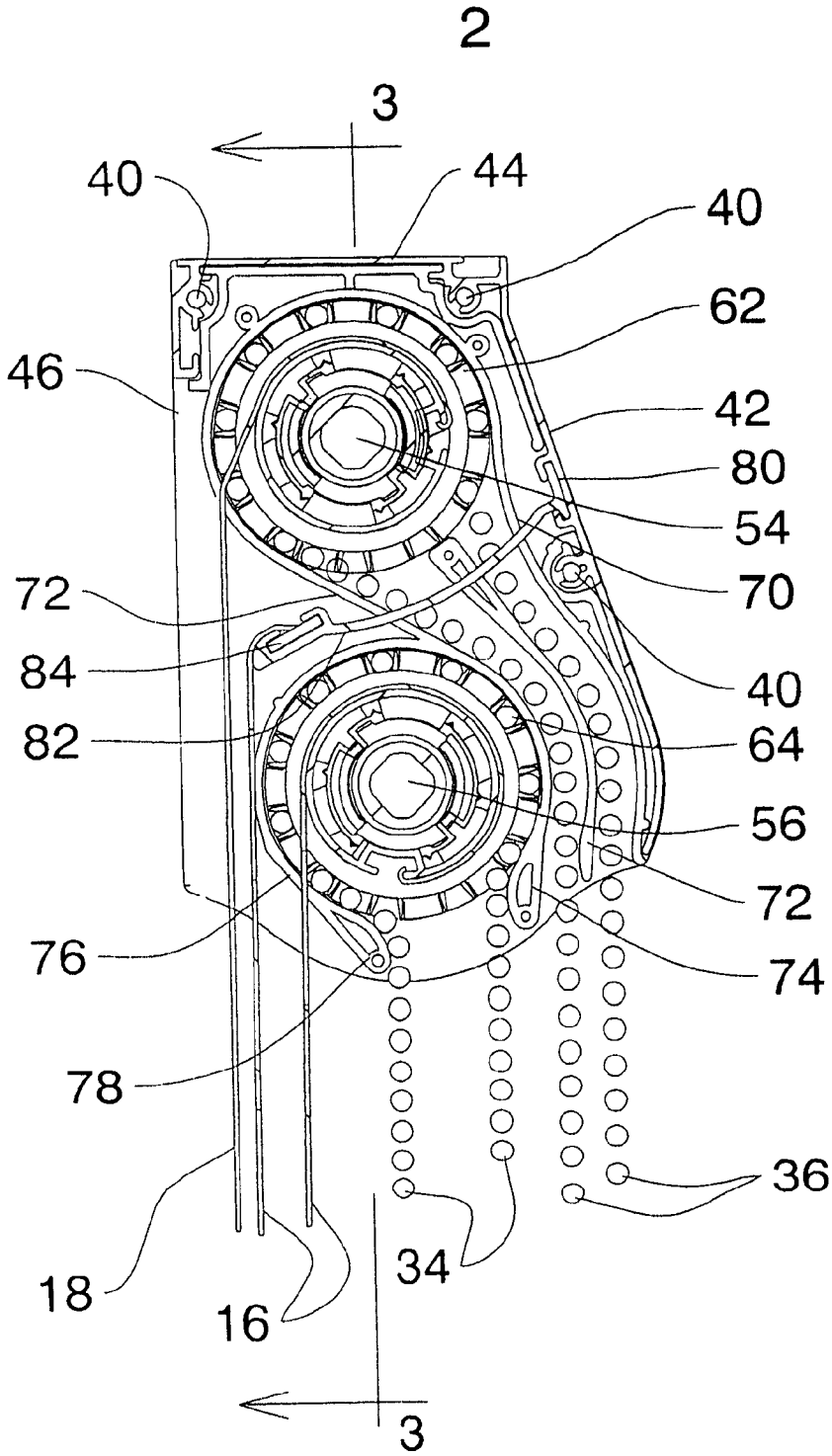
FIG. 2 is a section along line 2-2 of FIG. 1.
Figure 3:
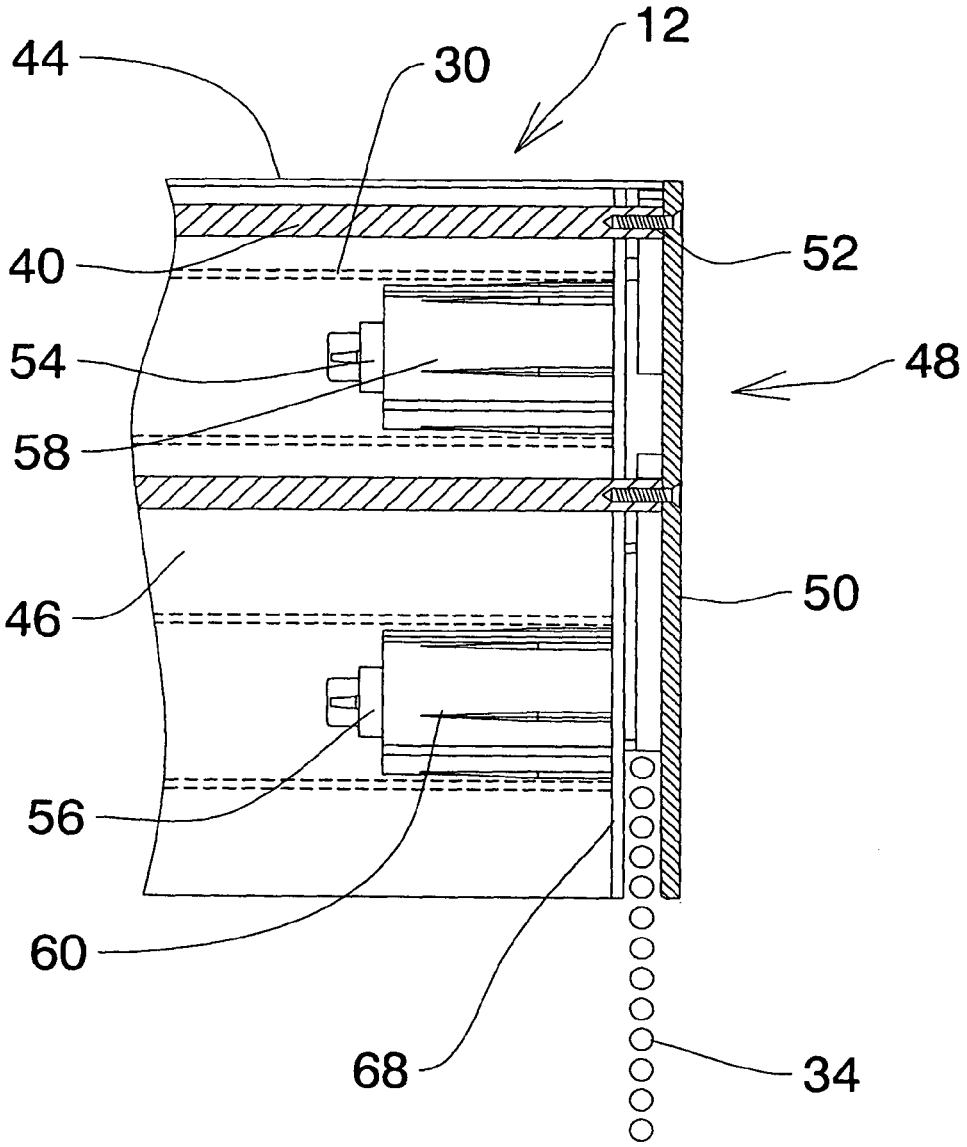
FIG. 3 is a section along line 3-3 of FIG. 1.
Figure 4:
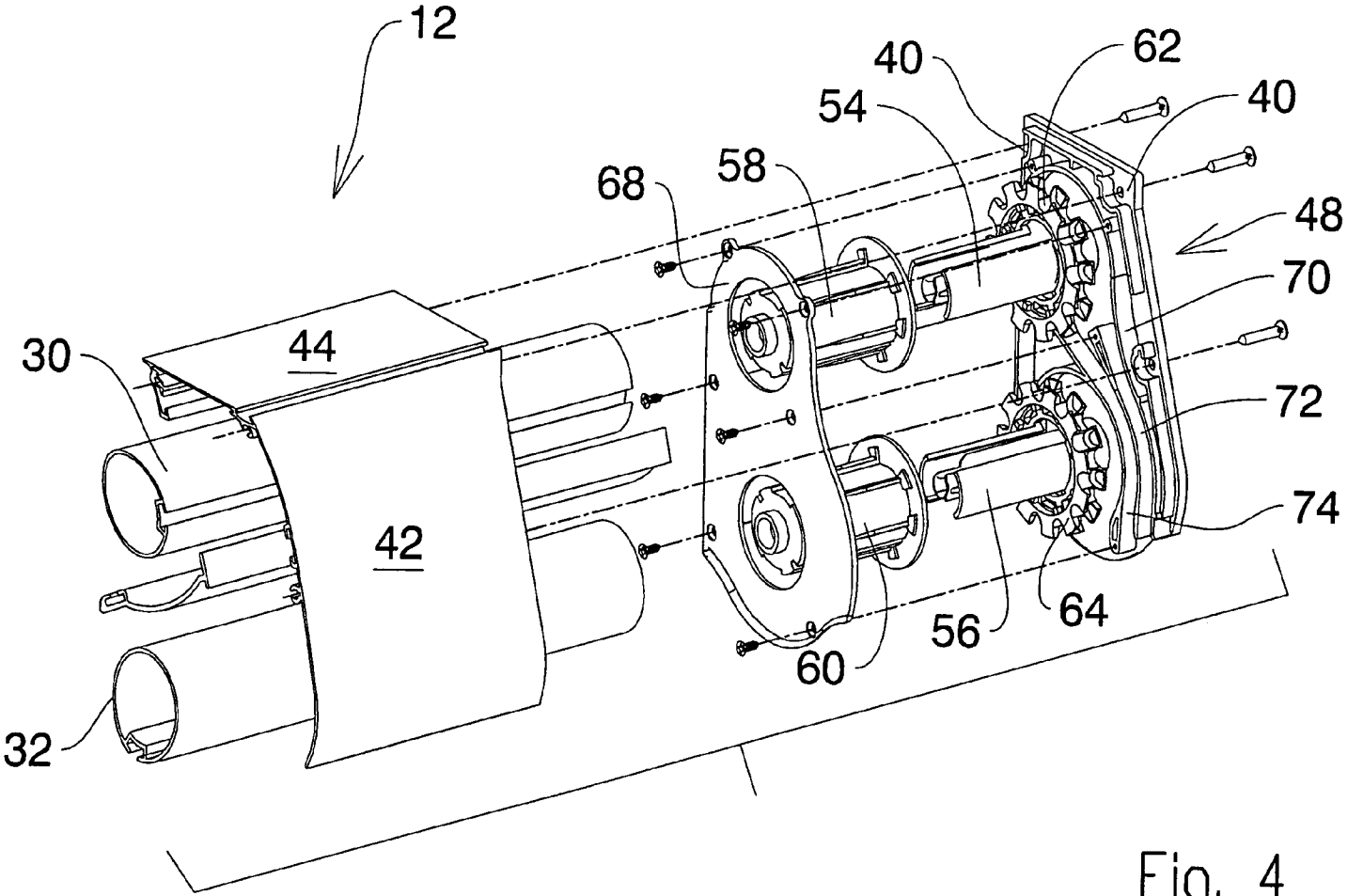
FIG. 4 is an exploded perspective of one end of the head rail.

The fastening wall extrusion (82) of FIG. 2 has been removed as it is not required. There is no dead end of the front panel (90) to be secured, in the head rail.

The second panel (94) is similar to the second panel of FIG. 2.

The control cords and guides are the same as in FIG. 2, and have the same reference numbers.

Figure 6:
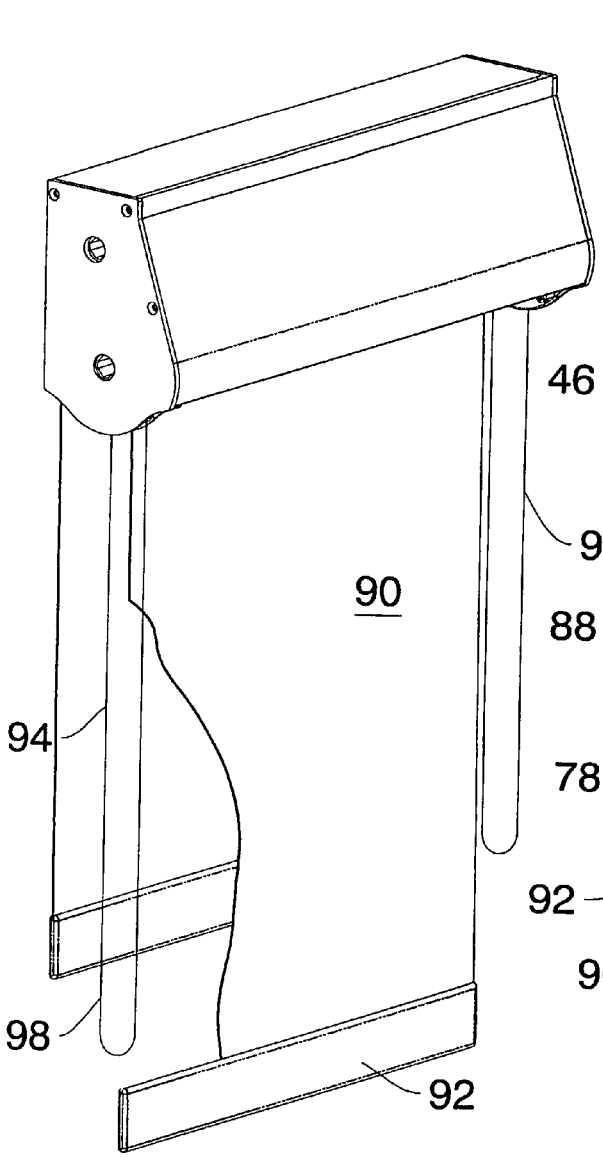
FIG. 6 is a perspective of another embodiment.

The cords are guided, as before, forwardly of the edges of the first and second panels Another possible variation is shown in FIG. 6.

In this case the front blind panel control cord (96) is shown located at one end of the head rail, and the control cord (98) for the second panel is located at the opposite end of the head rail.

In this case the end caps ( ) are the same as in FIG. 2, and both sets of control cords are guided forwardly of the edges of the two blind panels.

It is possible that the same headrail can be used for a simpler blind with only a single blind panel. In such a case there would be only one cord loop (not shown), but it would still be guided by the appropriate ribs and hang forwardly of the blind panel, so as to avoid damage to the edge of the panel.

The use of the forward guiding of the control cords also has the result of permitting the blind panel, or panels, to be made to the full width of the window opening, and thus provide for more effective light exclusion, when required.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A blind for a building opening, and comprising;

a head rail, attachable adjacent to the building opening;

a first blind roller supported in said head rail and a first blind control cord for operating said first blind roller;

a first blind panel stored in the head rail on said first blind roller, and adapted to be lowered over the building opening;

a second blind roller supported in said head rail separate from said first blind roller and a second blind control cord for operating said second blind roller independently of said first blind roller;

a second blind panel stored in the head rail on said second blind roller and adapted to be lowered over the building opening separately from said first blind panel;

first blind control cord guides in the head rail to lead the first blind control cord forwardly in front of the blind panels, second blind control cord guides in the head rail to lead the second blind control cord forwardly in front of the blind panels, so that both said control cords hang forwardly of the edges of the first and second blind panels, to avoid damaging the blind panels, and permitting the blind panels to fit the building opening to maximize privacy and light exclusion.

2. A blind for a building opening as claimed in claim 1 wherein said first blind panel guides include ribs for guiding said first blind panel control cord and wherein said second blind panel guides include ribs for guiding said second blind panel control cord.

3. A blind for a building opening as claimed in claim 2 wherein said headrail defines a front wall, a top wall and a back wall, and two ends, and including end caps for each said end of said head rail and wherein said guide ribs are formed integrally with at least one of said end caps.

4. A blind for a building opening as claimed in claim 3 including first and second hubs supported by said end caps, and sleeves on said hubs, for supporting respective said blind rollers.

5. A blind for a building opening as claimed in claim 4 including first and second drive gears on said respective said first and second hubs, connecting with said sleeves, and wherein respective said first and second control cords engage respective said first and second drive gears.

6. A blind for a building opening as claimed in claim 2 including a blind support wall in said headrail, extending between said first blind roller and said second blind roller and a blind panel attachment on said support wall engaging one end of said first blind panel.

7. A blind for a building opening as claimed in claim 2 wherein said guide ribs for said second blind control cord define an arc extending around and forwardly of said first blind panel roller, and wherein said guide ribs for said first blind panel control cord; include a lower portion extending forwardly of said first blind panel roller, and including an intermediate guide rib between said first panel control cord guide rib and said second panel control cord guide rib separating said second control cord from said first control cord.

8. A blind for a building opening as claimed in claim 1, wherein said first blind panel comprises a front panel portion and an intermediate panel portion hanging spaced apart wherein said intermediate panel portion is located between said front panel portion and said second panel.

9. A blind for a building opening, and comprising;

a head rail, attachable adjacent to the building opening;

a first blind panel stored in the head rail, and adapted to be lowered over the building opening;

a second blind panel stored in the head rail and adapted to be lowered over the building opening, at least one intermediate blind panel located between said first and second panels;

and wherein at least one of said first and second panel is formed of light permeable material, whereby to admit at least some light into the interior of the building;

a first blind panel control mechanism in the head rail whereby said first blind panel panels can be adjusted;

a second blind panel control mechanism in the head rail separate from said first blind panel control mechanism whereby said second blind panel can be adjusted independently of said first blind panel;

a first control cord connected to said first blind control mechanism for operation thereof;

a second control cord connected to said second blind control mechanism for operation thereof;

control cord guides leading the first and second control cords forwardly in front of the first and second blind panels, so that the control cords hang forwardly of the blind panels, to avoid damaging the blind panels, and permitting the blind panels to fit the building opening.

10. A blind for a building opening as claimed in claim 9 wherein said first panel is a front panelportion and an intermediate panel portion, and said second panel is a rear panel and wherein said front and intermediate panel portions hang separately from said second panel, and said second panel being formed of light impermeable material.

11. A blind for a building opening as claimed in claim 9, and including a first blind roller for said first panel, and a second blind roller for said second panel, with said second blind roller being located in an upper portion of said head rail, and said first blind roller being located in a lower portion of said head rail, below said second blind roller.

12. A blind for a building opening as claimed in claim 9, wherein said control cord guides include guide ribs terminating adjacent a lower edge of the blind head rail, and forward of said first blind roller.

13. A blind for a building opening as claimed in claim 12, wherein the front and intermediate blind panel portions comprise translucent material.

14. A blind for a building opening as claimed in claim 12 including a blind support wall releasably attached in said head rail, extending between said first blind roller and said second blind roller and a blind panel attachment on said support wall engaging one end of said first blind panel.

* * * * *